United States Patent [19]

LeVan

[11] Patent Number: 4,869,771

[45] Date of Patent: Sep. 26, 1989

[54] BONDED POLYESTER FIBERFILL BATTS

[75] Inventor: Martin D. LeVan, Wilmington, Del.

[73] Assignee: E. I. Du Pont de Nemours and Company, Wilmington, Del.

[21] Appl. No.: 110,672

[22] Filed: Oct. 26, 1987

[51] Int. Cl.[4] ..... B32D 31/00; B05B 3/02

[52] U.S. Cl. ..... 156/289; 156/166; 427/394; 427/407.1

[58] Field of Search ..... 156/289, 246, 276, 228, 156/181, 166, 176; 427/342, 394, 412, 407.1, 195, 202, 221, 344, 302, 407.3; 428/96, 97, 236, 238, 246, 265, 267, 262, 290, 261

[56] References Cited

U.S. PATENT DOCUMENTS

| | | | |
|---|---|---|---|
| 4,129,675 | 12/1978 | Scott | 428/288 |
| 4,281,042 | 7/1981 | Pamm | 428/288 |
| 4,429,002 | 1/1984 | Fukada et al. | 428/288 |
| 4,478,895 | 10/1984 | Makami et al. | 427/412 |
| 4,711,792 | 12/1987 | Long | 427/412 |

*Primary Examiner*—Michael W. Ball
*Assistant Examiner*—Louis Falasco

[57] ABSTRACT

An improved bonded polyester fiberfill batt, characterized by a lower inclination to leak fibers through a shell fabric, made by using a blend of binder fiber with binder-compatible fiberfill of low denier for the outer covering of the batt, and spraying thereon a resin-bonding agent, and effecting bonding of both binder fiber and bonding agent to form a sealed outer surface.

4 Claims, No Drawings

BONDED POLYESTER FIBERFILL BATTS

FIELD OF THE INVENTION

This invention is concerned with improvements in and relating to bonded polyester fiberfill batts, and more particularly to a process whereby such improved batts with a sealed outer surface may be obtained, and to articles incorporating such improved batts, and to materials for use in such a process.

BACKGROUND OF THE INVENTION

Polyester fiberfill (sometimes referred to as polyester fiberfilling material) has become well accepted as a reasonably inexpensive filling and/or insulating material for pillows, cushions and other furnishing materials, including bedding materials, and in apparel, and in manufactured and used in large quantities commercially. For many of these uses, as disclosed, e.g., in Tolliver, U.S. Pat. Nos. 3,772,137, Stanistreet, 4,068,036, Scott, 4,129,675, Pamm, 4,281,042, and Frankosky, 4,304,817, it has been desirable to make bonded batts, e.g., by spraying a resin-bonding agent, usually of an acrylic polymer, or by blending the polyester fiberfill with binder fibers, which are fibers of polymers having a lower melting or softening point, i.e., lower than that of the polyester fiberfill, and have the capability to adhere to and bond the polyester fiber.

To improve the aesthetics of polyester fiberfill, it has often proved desirable to "slicken" the fiberfill with a coating of durable (e.g., wash-resistant) coating, that has usually been a silicone, i.e., a cured polysiloxane, as disclosed, e.g., by Hofmann, U.S. Pat. No. 3,271,189, Mead et al., U.S. Pat. No. 3,454,422, Ryan, U.S. Pat. No. 3,488,217, Salamon et al., U.S. Pat. No. 4,146,674, and Takemoto Oil & Fat Co. Ltd., Japanese Published Patent Application No. 58-214,585 (1983), or other types as in copending application Ser. No. 07/180,150, filed by Marcus, April 13, 1988, now allowed, and in the prior art referred to above.

In practice, polyester fiberfill is generally inserted into and used within an outer covering, referred to as a shell fabric, sometimes, or ticking. A potentially serious problem has been leakage, or percolation, of the polyester fibers through the shell cover. This can be particularly serious in the case of insulated garments, because of the frequent flexing of portions of the garment, and the polyester fibers may form unslightly pills that detract from the appearance of the article. Hitherto, it is believed that, in practice, this tendency to leak fibers has been countered by use of a resin-bonding agent or by a non-woven scrim to assist in retaining the individual fibers and prevent leakage, i.e., to seal the outer surface. However, resin-bonding has not been satisfactory when commercially-available slickened polyester fiberfill has been used, because the resin-bonding agents do not adhere to silicone-slickened polyester fiberfill. Even when unslickened polyester fiberfill has been used, if sufficient resin-bonding agent is used, the result has often been unsatisfactory in the sense that the use of sufficient resin-bonding agent leads to a stiff, harsh product, so that one is faced with the dilemma of choosing between a stiff, harsh product or an unsolved leakage problem, i.e., an unsealed outer surface. The use of a non-woven scrim inside the shell fabric has sometimes provided a satisfactory answer to the leakage problem, but has been expensive both in regard to the cost of the non-woven scrim, in the sense of added material costs, and added processing and handling costs, and sometimes, depending on what has been used, can sometimes give an undesirably stiff result.

So, for a long time, a need has existed for solving the leakage problem in articles filled with polyester fiberfill, without incurring the disadvantages of prior attempts to solve this problem.

SUMMARY OF THE INVENTION

The present invention solves this problem by using a combination of a resin-bonding agent and compatible binder fiber in conjunction with compatible fine denier polyester fiberfill at the outer surface of the batt, and effecting bonding so as to seal this outer surface and minimize leakage. By "compatible", I mean that the polyester fiberfill is not slickened with a silicone-type slickener that renders it difficult or impossible to effect resin-bonding, and bonding with the binder fiber selected, and that the binder fiber itself is appropriately selected for the fiberfill. The degree of "sealing" that is desired for the outer surface will obviously depend largely on the materails used in the batt itself and in any outer shell fabric or other coverings, and also on the intended use of the final article, and the aesthetics that may be desired.

Accordingly, there is provided, according to the invention, a process for making a bonded batt with a sealed outer surface, comprising the steps of (1) forming a sandwich of a polyester fiberfill core with one or more outer layers consisting essentially of a compatible blend, by weight, of about 75 to about 90% of unslickened polyester fiberfill, of denier per filament about 1 to about 3, that is compatible with about 25 to about 10% of compatible binder fiber, (2) spraying a resin-bonding agent onto such outer layer in amount approximately 15%, calculated by weight of the total batt, and then heat-treating the batt to activate the binder fiber, and the resin-bonding agent, and thereby obtain the bonded batt, with such sealed outer surface. Generally, the sandwich will comprise two outer layers, on either side of and enveloping and sealing the core between the two outer layers, but some filling techniques involve use of an open-face sandwich, so that only a single outer layer on one side of the core is required, because this open-face sandwich itself envelopes in the final article itself or another body, so that only one surface (the outer surface) of the bonded batt presents a potential leakage problem, as is well known in the art.

There is also provided, according to the invention, the bonded batts themselves, and filled articles, especially garments containing the bonded batts.

DETAILED DESCRIPTION OF THE INVENTION

The essence of the invention is the balanced use of compatible binder fibers, in conjunction with low denier compatible polyester fiberfill that is capable of being bonded thereby upon activation by heat-treatment of the binder fiber in the outer layer of the batt, so as to form a matrix of bonded polyester fiberfill (bonded by the binder fiber) in conjunction with a skin, or effectively a scrim, formed in-situ, by activation by heat-treatment of resin binding agent that has been sprayed on the outer surface, whereby leakage can be effectively eliminated through the shell fabric that is subsequently used to cover the batt. I have found that use of binder fiber alone, or alternatively spraying a resin bonding agent alone, has disadvantages, in contrast with the result of the process of the present invention. As will be explained, some variation in the preferred proportions can be tolerated, but only to a limited extent before undesired results are obtained.

The invention is further illustrated in the following Example, demonstrating the advantages of using the invention, and preferred embodiments, and illustrating the undesirable results that can be obtained by using alternatives. All parts, proportions and percentages are by weight, as indicated herein.

EXAMPLE

A batt is formed from multiple layers of a card-formed or garnett-formed web, by cross-lapping the web on a moving apron to the batt thickness desired, such as disclosed in U.S. Pat. No. 3,290,704, with the interior or core of the batt being, if desired, of different composition from the outer layers of the batt by compartmenting the feed zone to the card or garnett, feeding the binder fiber blend to the feed zone which forms the edges of the web, and feeding the different fiberfill material to the central feed zone, and controlling the apron speed so that the strips of blend in the web form the upper and lower surfaces of the batt and the desired fiberfill material forms the interior of the batt, such as disclosed in French Patent Publication No. 2 269 598 and U.S. Pat. No. 3,740,282, i.e., in this respect, essentially as in the Examples of Scott, U.S. Pat. No. 4,129,675. Unlike Scott, however, both outer layers of the batts processed according to the present invention comprise a blend of 82% of unslickened polyester fiberfill of 1.65 dpf, solid round cross-section, and 1½ inches cut length, with 18% of the commercial sheath/core (50/50) binder fiber as disclosed used in copending application Ser. No. 921,646, referred to above, of 4 dpf, 1½ inches cut length. Each side of the batt is then sprayed with the acrylic polymer resin-bonding agent (TR-407, available commercially from Rohm and Haas) in amount approximately 18% by weight, and the batt is heat-bonded by being passed through an oven at 150° C. for 1 minute so as to activate the binder fiber and the resin-bonding agent, and thereby form a bonded batt.

The various batts are covered with a nylon shell fabric of 104×86 (W×F) construction, using nylon of 70 denier, and tested as described with the results in the following Tables, from which it will be seen that the bonded batts of the present invention show improved, i.e. reduced, leakage of filaments.

I-1. This is a preferred Example of the invention, using for the core commercial slickened hollow polyester fiberfill of about 5.5 dpf in an 82/18 blend with the same binder fiber. The product shows good sealing and batt-integrity.

I-2. This is an Example like I-1, except that the core is not a blend, but 100% of hollow fiberfill. The product is less preferred primarily because the core shows layering, as would be expected from the absence of binder fiber in the core. The sealing is considerably better than comparisons (discussed hereafter), and gets a "passing" rating, but is not as good as I-1.

C-H. This comparison is labelled H for "harsh", as the amount of binder fiber was increased to 38% in the outer layers (consisting of a blend of 62/38, instead of 82/18 in I-1, of low denier fiberfill/binder fiber) and this provided a harsher feel to the batt. Surprisingly, although the sealing gets a "passing" rating, it is not as good as I-1.

C-L. This comparison is labelled L for "leakage". It has the same core as I-1. The outer layers use a blend of 3 dpf unslickened solid round polyester fiberfill (instead of 1.65 dpf), but are otherwise similar (82/18 blend with the binder fiber). In other words, raising the denier even to 3 dpf allows these core fibers to leak through the outer layer.

C-LH. This comparison uses the same higher amount of binder fiber (38%) in the blend for the outer layers as in C-H, but is otherwise like C-L. Interestingly, this approach does not improve the leakage problem of C-L to any significant or adequate extent.

C-NB. This comparison is to demonstrate what happens when no resin-bonding agent is used, i.e., the leakage is worse than any of the preceding samples. For C-NB, there is no resin-bonding agent, the outer layers are from a blend as in I-1, but the core is a commercial 37.5/37.5/25 blend of low denier (1.6 dpf) unslickened solid round polyester fiberfill (as used in the outer layer for I-1) in amount 37.5%, with a similar amount of low denier fiberfill that is similar except that it is slickened, and with 25% of the same binder fiber.

C-SB. This comparison has some binder, and shows only marginal sealing (having deteriorated from an initially high rating, like C-H). It is similar to C-NB, except that 12% of resin-bonding agent is used (the core again containing fine denier fiberfill).

C. This comparison shows what happens if 15% resin-bonding agent is sprayed on in an attempt to seal a batt consisting (otherwise entirely) of the blend used for the core in I-1.

These Tables record the numbers of fibers leaked before (0) and after 50, 100 and 150 revolutions in a rotary drum according to a standardized testing procedure, with the resulting sealing rating for each Sample.

TABLE 1

| Sample Number | (Number of Revolutions) (0) | (50) | (100) | (150) | Sealing Rating |
|---|---|---|---|---|---|
| I-1 | 0 | 0 | 2 | 4 | 5 |
| I-2 | 0 | 4 | 7 | 9 | 4 |
| C-H | 1 | 3 | 5 | 7 | 4 |
| C-L | 8 | 17 | 28 | 35 | 1 |
| C-LH | 5 | 12 | 22 | 29 | 1 |
| C-NB | 17 | 35 | 50 | 62 | 1 |
| C-SB | 5 | 8 | 11 | 15 | 3 |
| C | 49 | 83 | 111 | 130 | 1 |

To summarize the ingredients used, all except C-NB had resin-bonding agent, and C-SB had only 12% (and low denier fiberfill in the core) whereas the others had 15%. All except C had outer layers; C-H and C-LH had 38% binder fiber, whereas the others had 18% binder fiber in the outer layer; the outer layers had low denier fiberfill, except for C-L and C-LH, which both had 3 dpf fiberfill in the outer layers. Only I-2 had no binder fiber in the core; C-NB and C-SB had slickened and unslickened low denier fiberfill in the core blend; the rest had slickened regular denier (hollow) fiberfill in the core blend.

The sealing rating is standardized from a low rating of 1 (failing), for more than 20 leaking fibers protruding by ¼-inch or longer over the surface of the standardized rectangular sample (11-inch fill by 22-inch warp, with over-edging, for the shell fabric), progressing upwards through 2 for 16–20 leaking fibers (poor), 3 for 11–15 leaking fibers (marginal), 4 for 6–10 leaking fibers (passing), to a high rating of 0.5 leaking fibers (good, i.e., good sealing).

Table 2 shows similar values, except that each side of each sample was tested separately, and the samples were tested first as in Table 1 (unwashed) and again after 3 wash cycles in a standardized washing procedure (referred to as 3C cycles).

TABLE 2

| Sample Identification | 0 | 50 | 100 | 150 | Rating |
|---|---|---|---|---|---|
| I-1 Unwashed-Side 1 | 1 | 1 | 1 | 1 | 5 |
| I-1 Unwashed-Side 2 | 1 | 2 | 3 | 3 | 5 |
| I-1 Washed-Side 1 | 1 | 1 | 1 | 1 | 5 |
| I-1 Washed-Side 2 | 1 | 2 | 3 | 3 | 5 |
| I-T Unwashed-Side 1 | 0 | 1 | 1 | 1 | 5 |
| I-T Unwashed-Side 2 | 0 | 1 | 3 | 2 | 5 |
| I-T Washed-Side 1 | 1 | 2 | 1 | 1 | 5 |
| I-T Washed-Side 2 | 0 | 1 | 1 | 1 | 5 |

These results in Table 2 confirm (for I-1) the good sealng rating shown in the tests performed for Table 1, and also show that this good sealing holds true even after three wash cycles. Another sample of the invention (I-T) was tested and showed similar good sealing. I-T is similar to I-1, except for the core, which is a blend of 55 slickened/27 unslickened/18 binder fiber, the binder fiber and unslickened fiberfill being as used in the cores for C-NB and C-SB of Table 1, but with 55% of a commercial 4-hole slickened polyester fiberfill of 5.5 dpf.

The amount of resin-bonding agent should generally be about 15%, with a tolerance of about 3%, more or less, although this will naturally depend on the materials used in combination. If too little resin-bonding agent is used, fiberfill will tend to leak, i.e., the objective will not be achieved, whereas too much resin-bonding agent will give an undesirable stiff skin on the bonded batt, i.e. the aesthetics will suffer in this respect. The proportion of binder fiber in the outer layer was about 18% (but with regard to the total of the fiber blend, i.e., the binder fiber and unslickened polyester fiberfill), because this is convenient using the system described. If too much binder fiber is used, e.g. as much as 38%, the resulting batt feels harsh, whereas too little will not provide the desired bonded matrix, so that the intrgrity of the matrix will suffer. In this regard, it will be noted that about 5% of binder fiber is too little, whereas about 10% of binder fiber, and specifically 9%, has given good results.

I claim:

1. A process for preparing a bonded batt of staple poly(ethylene terephthalate) fiberfill with a sealed outer surface, by the steps of first forming an unbonded batt by (1) forming a sandwich of a core containing staple slickened polyester fiberfill with an outer layer, wherein such outer layer consists essentially of a compatible blend, by weight, of about 75 to about 90% of unslickened polyester fiberfill of denier about 1 to about 3, that is compatible with about 25 to about 10% of compatible binder fiber, and comprises about one-tenth to about one-third of the weight of the sandwich, and (2) spraying a resin-bonding agent onto such outer layer in an amount approximately 15%, calculated on the total weight of the batt, followed by heat-treating the unbonded batt to activate the binder fiber and resin-bonding agent, and thereby form a bonded batt.

2. A process according to claim 1, wherein the polyester fiberfill in the said outer layer is coated with a non-silicone-slickener based on on a polyethylene oxide derivative that permits bonding of the polyester fiberfill by the binder fiber.

3. A process according to claims 1 or 2, wherein the sandwich has two such outer layers, and the resin-bonding agent is sprayed downwardly, first onto one such outer layer and then onto the other such outer layer, as the sandwich is passed underneath successively, with first the one such outer layer uppermost and then the other such outer layer uppermost.

4. A process according to claims 1 or 2, wherein the sandwich has a single such outer layer that is wrapped around, so that the outer layer is presented outwardly of the wrapped article.

* * * * *